US005580007A

United States Patent [19]

Caviezel et al.

[11] Patent Number: 5,580,007

[45] Date of Patent: Dec. 3, 1996

[54] DEVICE AND METHOD FOR REDUCING IN SIZE AND MIXING OF MATERIAL

[75] Inventors: Rafael Caviezel, Saas; Rudolf Solenthaler, Flawil, both of Switzerland

[73] Assignee: Buchi Labortechnik AG, Flawil, Switzerland

[21] Appl. No.: 246,715

[22] Filed: May 20, 1994

[30] Foreign Application Priority Data

Jun. 7, 1993 [CH] Switzerland ..... 1697/93

[51] Int. Cl.[6] ..... B02C 18/06; B02C 18/10

[52] U.S. Cl. ..... 241/199.12; 241/259; 241/277

[58] Field of Search ..... 241/27, 199.12, 241/277, 259

[56] References Cited

U.S. PATENT DOCUMENTS

| | | | |
|---|---|---|---|
| 1,158,198 | 10/1915 | Franke | 241/277 X |
| 2,903,198 | 9/1959 | Asplin | 241/199.12 X |
| 3,335,772 | 8/1967 | Menge | 241/277 |
| 4,072,275 | 2/1978 | Bartels et al. | 241/79 |
| 4,366,930 | 1/1983 | Trombetti, Jr. | 241/169 |
| 4,828,395 | 5/1989 | Saito et al. | 241/259 X |
| 5,104,050 | 4/1992 | Herbert | 241/37.5 |
| 5,396,898 | 3/1995 | Bittmann et al. | 241/277 X |

FOREIGN PATENT DOCUMENTS

| | | |
|---|---|---|
| 1156820 | 5/1958 | France . |
| 2147346 | 3/1973 | France . |
| 2190507 | 2/1974 | France . |
| 1296956 | 10/1969 | Germany . |
| 424111 | 5/1967 | Switzerland . |

*Primary Examiner*—John M. Husar
*Attorney, Agent, or Firm*—Shoemaker and Mattare, Ltd.

[57] ABSTRACT

With a device for reducing in size and mixing material (4), a blade (12) rotates in a the working chamber (2) of a container (3). During reducing in size and mixing, the working chamber (2) is reduced in volume by means of a piston.

7 Claims, 4 Drawing Sheets

DEVICE AND METHOD FOR REDUCING IN SIZE AND MIXING OF MATERIAL

BACKGROUND OF THE INVENTION

The invention concerns a device and a method for reducing in size and mixing of material.

These types of cutting, pulverising and/or mixing devices are required mainly in the laboratory area, for the most varied of uses. With differing materials, difficulties can occur because the material is repelled by the blade, for example, and not cut, or because the material is carried along by the blade and not cut, or because, for any other reason, the consistency of the material does not permit faultless pulverising or cutting and/or mixing. This applies mainly to fibrous, flakey or strip materials with low specific gravity and in a dry condition.

SUMMARY OF THE INVENTION

The purpose of the invention is to avoid these known disadvantages, in particular therefore to create a universally deployable device and method which reliably enables the reducing in size of the most varied dry or moist materials, alone or in solid or dry suspension or other conditions of mix.

According to the invention, this purpose is fulfilled primarily by the method and apparatus described below.

Through the reduction in volume of the work chamber from above, loose, fibrous, downy or foam formed mixing materials can also be reliably and continuously reduced in volume, compacted and fed to, as well as held within, the cutting area of the blade. With such materials, the working chamber must be reduced in volume as the blade is lowered. It is essential that this takes effect, for example through the lowering of a piston or another compression device, since at the same time the working chamber will be progressively reduced in volume from the direction of and together with the working area of the blade. The invention can be realised in a particulary simple way, however, if the device for reducing the volume of the working chamber is a piston arranged to be able to move in a cutting or mixing container. The container can evidently be a normal commercially available container or bowl, into the opening of which the blade and the piston can be introduced. At the same time it is important that the piston approximately corresponds to the inside diameter of the container, so that no excessive free annular space between the piston and the container will arise. Here, arrangements have proven themselves with which the blade is arranged on a rotating shaft within the container, and with which the piston can be lowered together with the blade. It is practical if the shaft and the piston are fixed to a holder which is able to be lowered.

In order to avoid continual compression of the material and a collision between the material in the container and the piston, it is particularly practical if the piston is mounted with spring action on a bearing device.

The bearing can be mounted on the holder for the blade, respectively on the rotating shaft, in a constructively simple way. Alternatively, it is also possible to fasten the piston, for example directly on the container or on a separate auxiliary device.

BRIEF DESCRIPTION OF THE DRAWINGS

The invention is more closely explained in the following embodiments, and with the aid of the drawings.

DESCRIPTION OF THE PREFERRED EMBODIMENT

Figure 1:
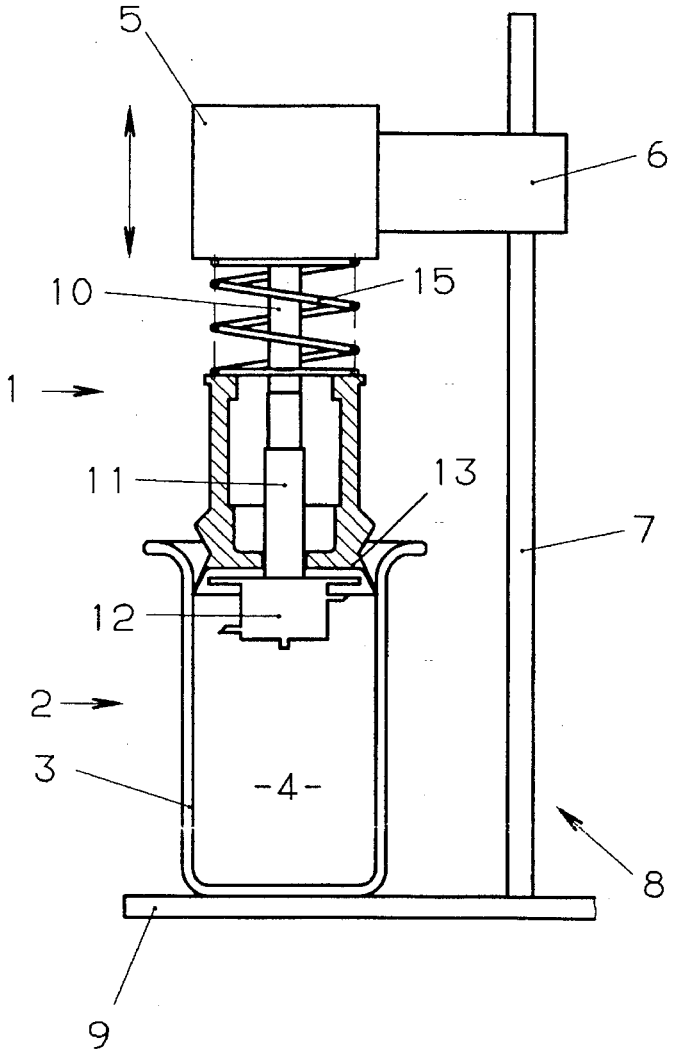
FIG. 1 is a schematic portrayal of a device with the features of the invention.
Figure 1A:
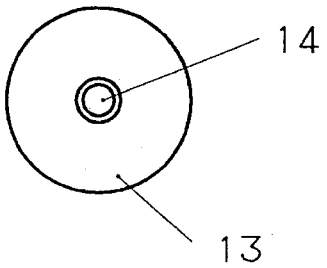
FIG. 1*a* is a plan view of the piston according to FIG. 1.
Figure 2:
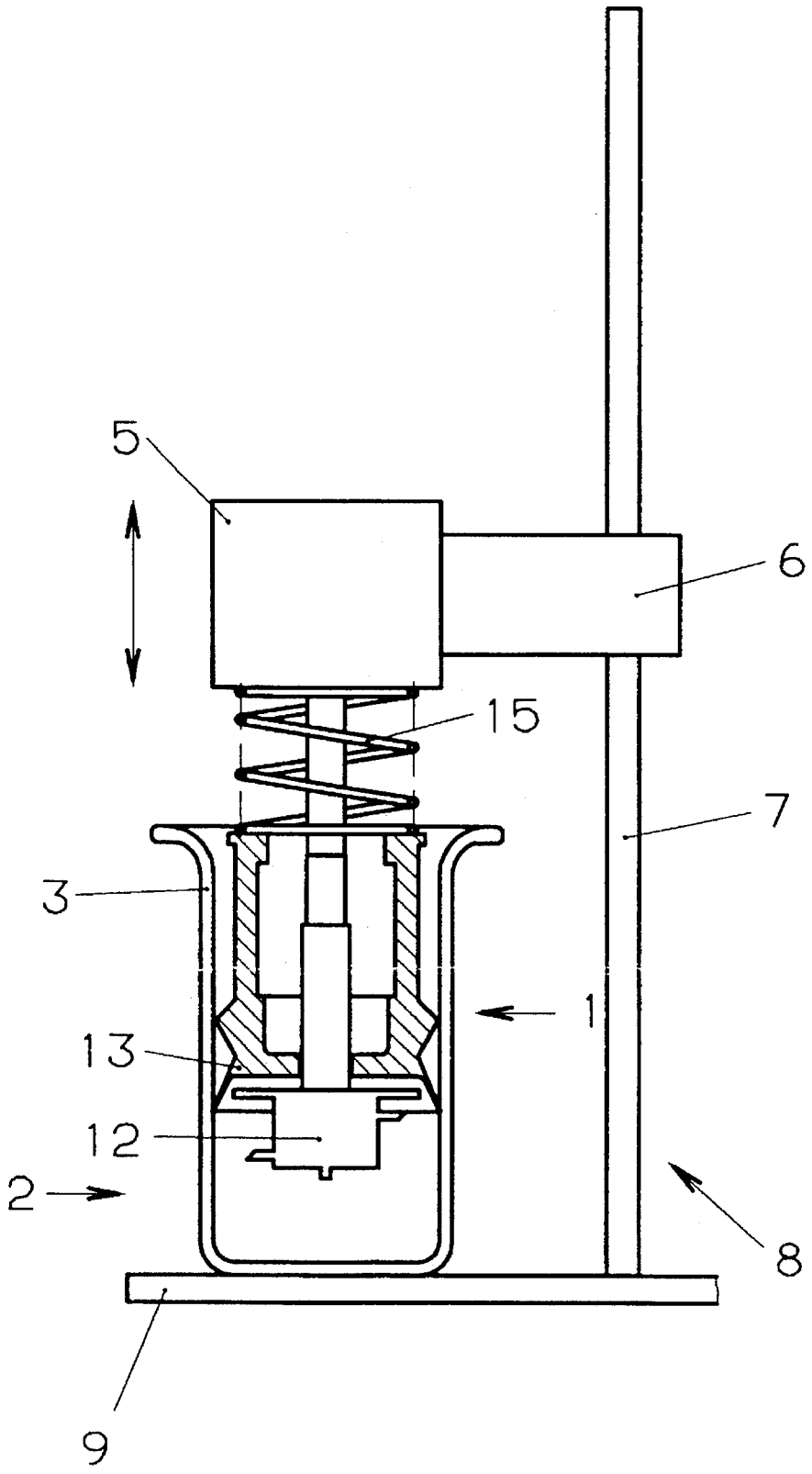
FIG. 2 shows the device according to FIG. 1 with a lowered blade and reduced working chamber volume.

According to FIGS. 1 and 2, a device 1 embodying the invention possesses a drive motor 5 for the reducing in size of material 4 located in the working chamber 2 of a container 3. The drive motor 5 is fastened to the column 7 of a support 8 by means of a lowering device 6. The container 3 stands, able to be exchanged, upon the base plate 9 of the support 8. A mounting tube 10 is fastened onto the drive motor 5, within which a drive shaft 11, driven by the motor 5, rotates. A blade 12 is fastened to the shaft 11. Apart from that, a piston 13 is arranged on the mounting tube 10. The piston 13 possesses a central bore 14 which is able to displace vertically on the mounting tube 10. The piston 13 is consequently held to be vertically displaceable by means of a spring 15 around the mounting tube 10, between the piston and the drive motor 5.

FIG. 1 shows the commencement of the cutting procedure of a loose, fibrous material with high volume. As can be seen in FIG. 1, first of all the blade 12 is inserted into the container 3, the material 4 being mainly flung outwards, but not in principle being cut. FIG. 2 shows how, on further lowering of the blade 12 and piston 13, the working chamber 2, moving together with the lowering cutting area of the blade, is reduced in volume, by which means the loose material 4 is compressed and brought into the cutting area of the blade 12, and is held there. In this way, the material 4 can be faultlessly reduced in size. The spring 15 at the same time permits upward deflection of the piston if a specific density of material 4 is reached. The force of the spring 15 can be set appropriately according to the performance of the motor 5, the blade 12 employed, the performance of the lifting and lowering motor and the intended use.

Figure 3:
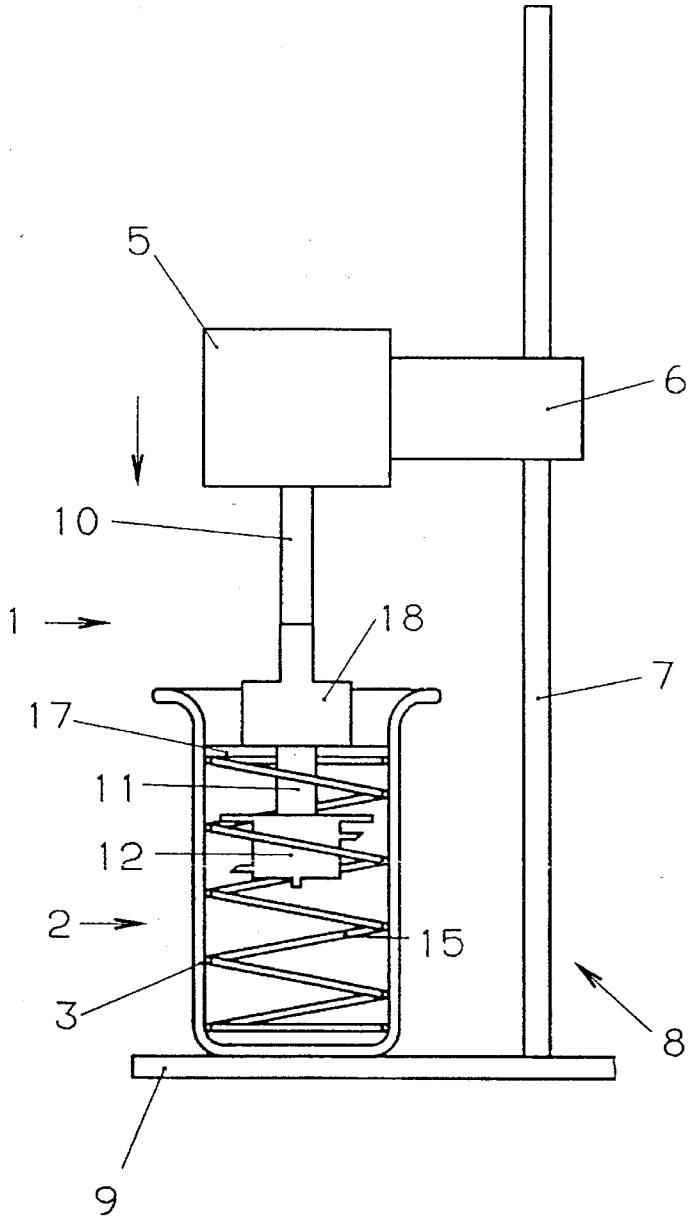
FIGS. 3, 3*a* and 4 depict a modified embodiment of the invention in two different operating conditions.
Figure 3A:
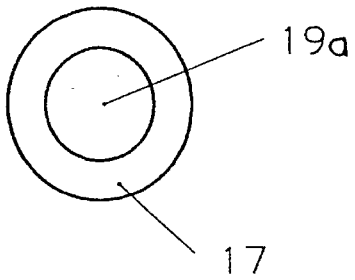
Figure 4:
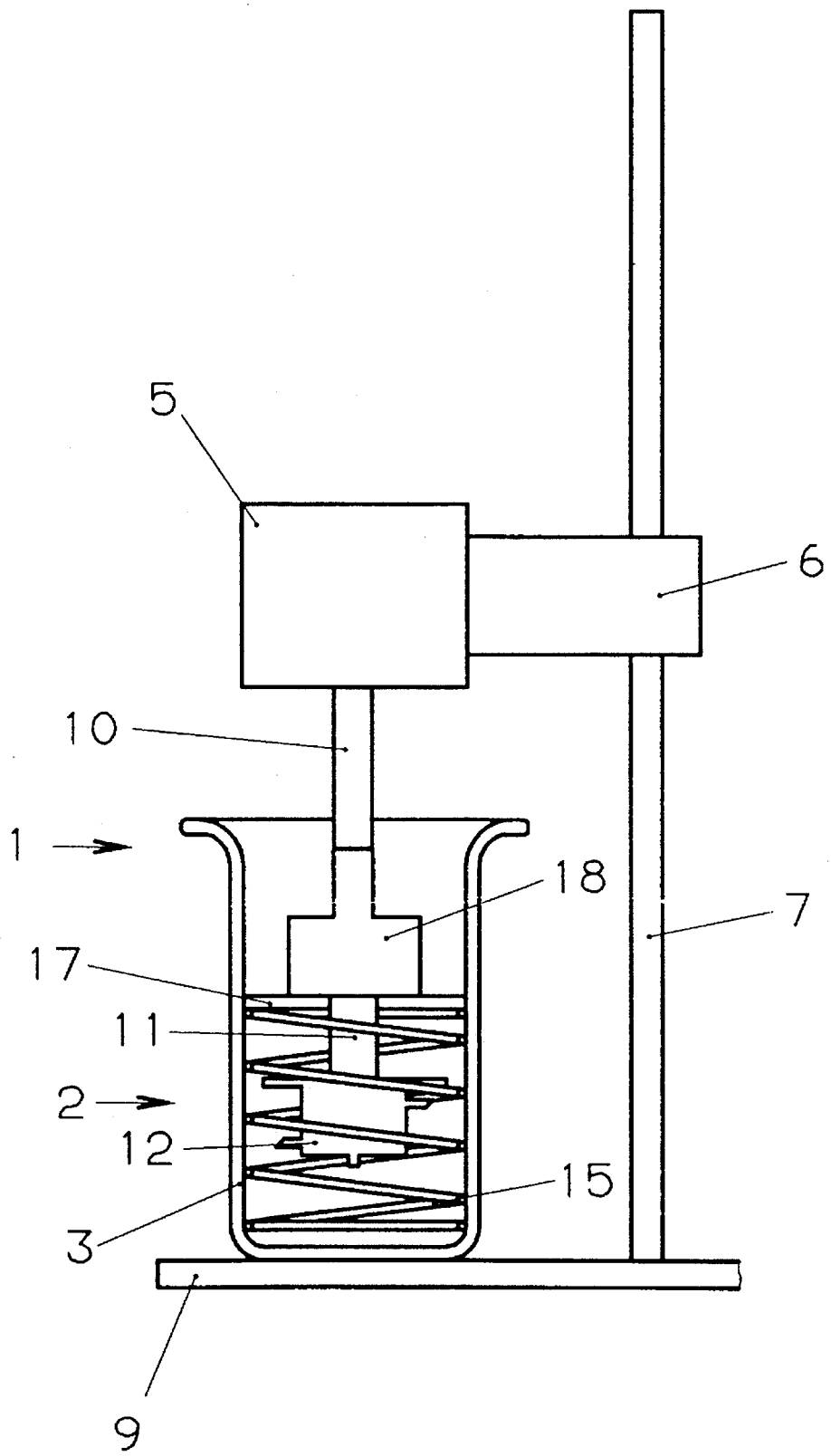

FIG. 3 shows an embodiment wherein an annular shaped lid 17 is provided as a device to reduce the volume of the working chamber 2 in the container 3. The lid 17 rests upon a spring 15 which is placed downwards into the container 3. A cylindrical thickened section 18 is provided on the mounting tube 10 for the blade 12, said thickened section 18 closing the opening 19 in the lid 17 when the drive motor 5 lowers by means of the lowering device 6. On further lowering, the lid 17 is pressed by the thickened section 18 downwards against the force of the spring. With that, in accordance with FIG. 4, the working chamber 2 is reduced in volume, analogue to the embodiment according to FIG. 1. The function of the arrangement otherwise corresponds to the embodiment according to FIG. 1. Evidently, in this case different heights of spring and/or different depths of thickened section 18 and adapted lids 17 can be used, in order to enable optimum volume reduction of the working chamber according to the material which fills it. The arrangement according to FIG. 3 and 4 permits easy removal of both spring 15 and lid 17 from the container 3, e.g. for cleaning.

Inasmuch as the invention is subject to modifications and variations, the foregoing description and accompanying drawings should not be regarded as limiting the invention, which is defined by the following claims and various combinations thereof:

What is claimed is:

1. A mixing device comprising a closed-bottom container defining a working chamber for containing a material, a rotatable blade for mixing and comminuting the material, a shaft for supporting and turning the blade within the chamber, means for raising and lowering the shaft during operation whereby the blade can be moved vertically within the material in the chamber as the blade rotates, and means for confining the material and for reducing the volume of the working chamber during operation, said means being movable within the chamber independently of the blade and the shaft, whereby the blade can simultaneously both rotate and move vertically within the chamber, while the material is being mixed.

2. A device according to claim 1, wherein the volume reducing means comprises a piston movable within the container.

3. A device according to claim 2, wherein the piston can be lowered into the container.

4. A device according to claim 3, further comprising a spring for biasing the volume reducing means downward against said material.

5. A device according to claim 4, further comprising a holder to which both the shaft and the spring are connected, so that they are lowered in unison.

6. A device according to claim 4, further comprising a holder to which both the rotating device and the spring are fastened.

7. A device according to claim 2, further comprising a holder to which both the piston and the shaft are connected, whereby the blade and the piston move in unison.

* * * * *